US007950765B2

(12) United States Patent
Takabayashi et al.

(10) Patent No.: US 7,950,765 B2
(45) Date of Patent: May 31, 2011

(54) LIQUID DISCHARGE HEAD AND LIQUID DISCHARGE APPARATUS USING LIQUID DISCHARGE HEAD

(75) Inventors: Hiroshi Takabayashi, Atsugi (JP); Hideo Kanno, Yokohama (JP); Takatsuna Aoki, Yokohama (JP); Seiichiro Karita, Toda (JP)

(73) Assignee: Canon Kabushiki Kaisha., Tokyo (JP)

( * ) Notice: Subject to any disclaimer, the term of this patent is extended or adjusted under 35 U.S.C. 154(b) by 0 days.

(21) Appl. No.: 12/757,478

(22) Filed: Apr. 9, 2010

(65) Prior Publication Data

US 2010/0194810 A1 Aug. 5, 2010

Related U.S. Application Data

(62) Division of application No. 11/689,855, filed on Mar. 22, 2007, now Pat. No. 7,722,148.

(30) Foreign Application Priority Data

Mar. 31, 2006 (JP) ..... 2006-098674
Mar. 15, 2007 (JP) ..... 2007-066591

(51) Int. Cl.
*B41J 2/14* (2006.01)

(52) U.S. Cl. ..... 347/17; 347/5; 347/14

(58) Field of Classification Search ..... 347/5, 9, 347/12, 14, 17, 19, 67, 189
See application file for complete search history.

(56) References Cited

U.S. PATENT DOCUMENTS

| | | | | |
|---|---|---|---|---|
| 4,550,327 | A | 10/1985 | Miyakawa | |
| 4,591,876 | A * | 5/1986 | Nozaki et al. | 347/189 |
| 4,947,194 | A * | 8/1990 | Kyoshima | 347/67 |
| 5,398,053 | A | 3/1995 | Hirosawa et al. | |
| 5,530,462 | A | 6/1996 | Takahashi et al. | |
| 5,734,391 | A | 3/1998 | Tanaka et al. | |
| 5,774,137 | A | 6/1998 | Yoshida | |
| 6,174,039 | B1 | 1/2001 | Miyake et al. | |
| 6,827,416 | B2 * | 12/2004 | Matsumoto et al. | 347/17 |
| 2002/0070992 | A1 * | 6/2002 | Fukano | 347/17 |
| 2009/0085946 | A1 | 4/2009 | Aoki et al. | |

FOREIGN PATENT DOCUMENTS

| | | | |
|---|---|---|---|
| EP | 0380056 | A2 | 8/1990 |
| JP | 58-118267 | A | 7/1983 |
| JP | 2-194967 | A | 8/1990 |
| JP | 2-276647 | A | 11/1990 |
| JP | 6-079956 | A | 3/1994 |

* cited by examiner

*Primary Examiner* — Lam S Nguyen
(74) *Attorney, Agent, or Firm* — Fitzpatrick, Cella, Harper & Scinto

(57) ABSTRACT

A compact and highly reliable recording head enabling precise detection of temperature information for each nozzle and rapid as well as highly accurate detection of nozzles with a discharge defect can be achieved. An electrothermal transducing member is provided on a substrate to generate heat energy for discharging liquid from a discharge port. A temperature detecting circuit includes a temperature detecting element for measuring a temperature of the transducing member. The temperature detection circuit includes a constant current circuit, a voltage detecting circuit, and a switching element.

4 Claims, 14 Drawing Sheets

LIQUID DISCHARGE HEAD AND LIQUID DISCHARGE APPARATUS USING LIQUID DISCHARGE HEAD

This is a division of U.S. patent application No. 11/689,855, filed Mar. 22, 2007, now U.S. Pat. No. 7,722,148.

BACKGROUND OF THE INVENTION

1. Field of the Invention

The present invention relates to a liquid discharge head and a liquid discharge apparatus using the liquid discharge head.

2. Description of the Related Art

An ink jet printer (ink jet recording apparatus) is now being widely used as a liquid discharge apparatus. An ink jet head is used as a liquid discharge head in that printer. That ink jet head is based on various types of liquid discharge principles. The widespread type used in particular is an ink jet head applying thermal energy to ink to discharge ink drops from a discharge port. That type of ink jet head is advantageous in that responsiveness to record signals is good and enhancement in high density of the discharge port on a multilevel basis is easy.

However, in an ink jet printer (ink jet recording apparatus) with such an ink jet head, foreign material occasionally blocks the discharge port or bubbles mixed into inside the ink supply route occasionally blocks the ink supply route thereof. An occurrence of such events will result in ink discharge defects of an ink jet head. In particular, a so-called full-line type recording apparatus provided with a great number of discharge ports being arranged in a lined state enabling ink jet recording corresponding with the entire width of recording media enables rapid recording execution. Nevertheless, it is extremely important to specify the discharge port (discharge nozzle) having caused discharge defects rapidly to be reflected onto image complementation and ink discharge recovering work.

Technology for solution of such discharge defects is known.

Japanese Patent Application Laid-Open No. H6-079956 describes a recording method, moving image data to be given to an abnormal recording element to image data to be given to another recording element even in an occurrence of abnormality in a recording element and thereby causing the other recording element to complement the record. However, that recording method carries out processing of reading a check pattern discharged onto a detection sheet to detect an abnormal recording element and to superpose image data to be added to that detected recording element onto image data of another recording element. That processing is applicable to a recording apparatus with slow response speed, but is hardly applicable to a recording element with fast response speed such as a full-line type recording apparatus.

Moreover, Japanese Patent Application Laid-open No. H2-276647 describes a recording apparatus for detecting a discharge port having caused discharge defects in a line-type recording head to carry out recording with a serial type recording head on a recording position corresponding with the discharge port. However, that discharge defect detection method detects transmitting a heat timing signal to a heat generating resistor member, and detects a signal flowing in the heat generating resistor member at that occasion to detect whether or not the heat resistor member is broken.

Moreover, Japanese Patent Application Laid-Open No. S58-118267 described a recording head as illustrated in FIG. 16. There described is a liquid discharge apparatus provided with a temperature change detecting conductor portion 102 inside a flow channel (inside a nozzle) between adjacent electrothermal energy transducing members 101, including a plurality of nozzles 100 arranged in a row. Moreover, there also described is a liquid discharge apparatus provided with a conductor portion 102 on the rear surface of the side opposite to the surface of a substrate 103 provided with an electrothermal energy transducing member 101 and in a position corresponding with a nozzle 100. However, the case where the conductor portion 102 is provided sideway of the electrothermal energy transducing member 101 is susceptible to influence of heat of the adjacent electrothermal energy transducing member and is susceptible to influence covering thickness of the substrate 103 in the case of providing the conductor portion 102 on the rear surface side of the substrate 103. Therefore, it becomes difficult to precisely detect temperature changes occurring due to repetition of rapid temperature increase and decrease within an extremely short time period.

SUMMARY OF THE INVENTION

An object of the present invention is to provide a compact and highly reliable recording head enabling precise detection of temperature information on each nozzle and rapid as well as highly accurate detection on nozzles with a discharge defect.

Another object of the present invention is to provide a liquid discharge head including a plurality of electrothermal transducing members provided on a substrate to generate heat energy for discharging liquid from a discharge port, including a temperature detecting element formed immediately under each of the plurality of electrothermal transducing members to sandwich insulating film; and a temperature detecting circuit for detecting temperature information from each of the temperature detecting elements.

Further features of the present invention will become apparent from the following description of exemplary embodiments with reference to the attached drawings.

DESCRIPTION OF THE EMBODIMENTS

Next, embodiments of the present invention will be described with reference to the drawings.

First Embodiment

Figure 1:
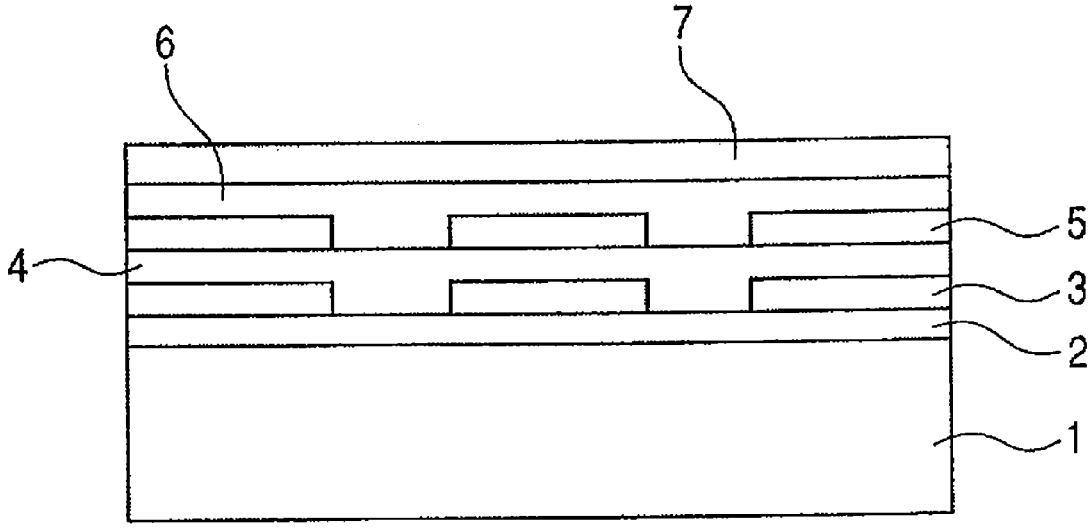
FIG. 1 is a sectional view of a recording head mounted on a recording apparatus being a first embodiment of the present invention.
Figure 2:
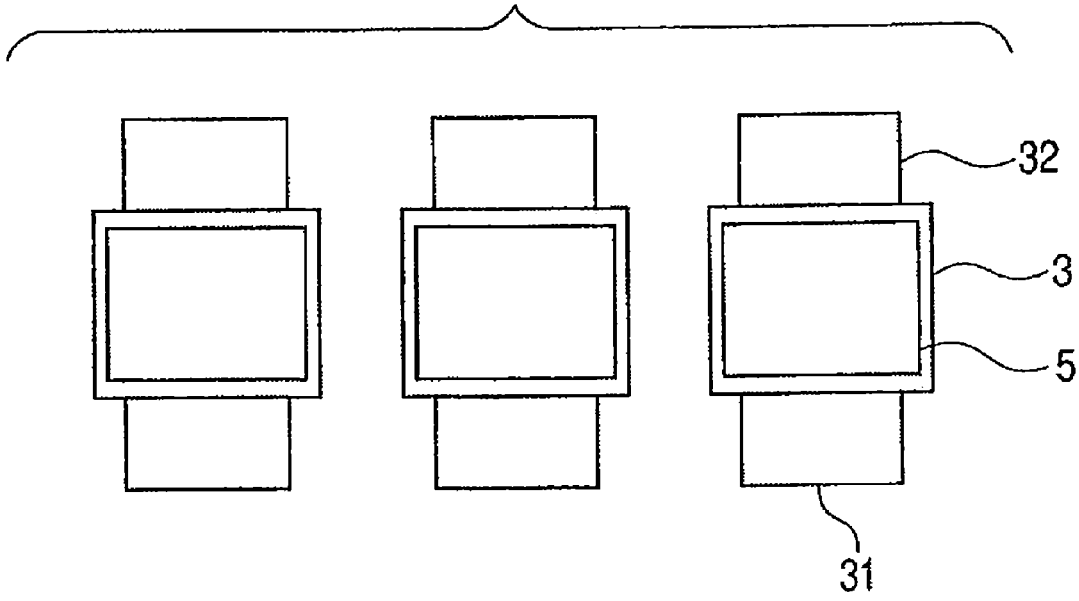
FIG. 2 is a plan view of the recording head mounted on the recording apparatus being the first embodiment of the present invention.

FIG. 1 and FIG. 2 are a sectional view and a plan view respectively of a recording head mounted on a recording apparatus being a first embodiment of the present invention. In FIG. 1 and FIG. 2, a discharge nozzle portion including a discharge port, a liquid route and the like is omitted.

With reference to FIG. 1, a heat accumulating layer 2 is formed on a Si substrate 1. A plurality of temperature detecting elements 3 is formed on the heat accumulating layer 2. A plurality of heaters 5 is formed on the heat accumulating layer 2 in which the temperature detecting elements 3 are formed to sandwich interlayer insulating film 4. Moreover, cavitation-resistant film 7 is formed on the surface where the heaters 5 are formed to sandwich passivation film 6. Respective layers selected from the group including the heat accumulating layer 2, the temperature detecting elements 3, the interlayer insulating film 4, the heaters 5, the passivation film 6, and the cavitation-resistant film 7 are highly densely stacked with known semiconductor processing.

The heat accumulating layer 2 is a thermally-oxidized film such as $SiO_2$. The temperature detecting element 3 includes thin film resistor member selected from the group including Al, AlCu, Pt, Ti, TiN, TiSi, Ta, TaN, TaSiN, TaCr, Cr, CrSiN, and W. The heaters 5 include an electrothermal transducing member such as TaSiN. The passivation film 6 includes $Si0_2$ and the like. The cavitation-resistant film 7 intensifies cavitation-resistant properties of the heaters 5. The thin film resistor member included in the temperature detecting elements 3 is formed separately and independently immediately below the electrothermal transducing member included in each heater 5.

The temperature detecting elements 3 and the heaters 5 are all rectangular as illustrated in FIG. 2. The area of a temperature detecting element 3 is larger than the area of a heater 5. In the case of viewing the heaters 5 from the upper side of the Si substrate 1, the heater 5 is positioned approximately in the center of the temperature detecting element 3. An end (terminal) of the temperature detecting element 3 is connected to individual wiring 31. The other end (terminal) is connected to common wiring 32. The individual wiring 31 and the common wiring 32 made of Al and the like are formed together with the temperature detecting element 3 on the Si substrate 1. Here, circuits selected from the group including a switching element, a control circuit, and a circuit for detecting temperature are not illustrated in FIG. 1 and FIG. 2, but are formed on the Si substrate 1 in order to control the temperature detecting elements 3 and heaters 5.

According to the recording head of the present embodiment, the temperature detecting elements 3 are formed immediately under the heaters 5 (between the heaters 5 and the Si substrate 1). Therefore, the temperature changes due to heat dissipation from the heaters 5 can be detected rapidly and accurately. In addition, the condition having discharged ink normally and the condition with non-discharge of ink can be determined precisely. The reasons will be described below specifically.

Figure 3:
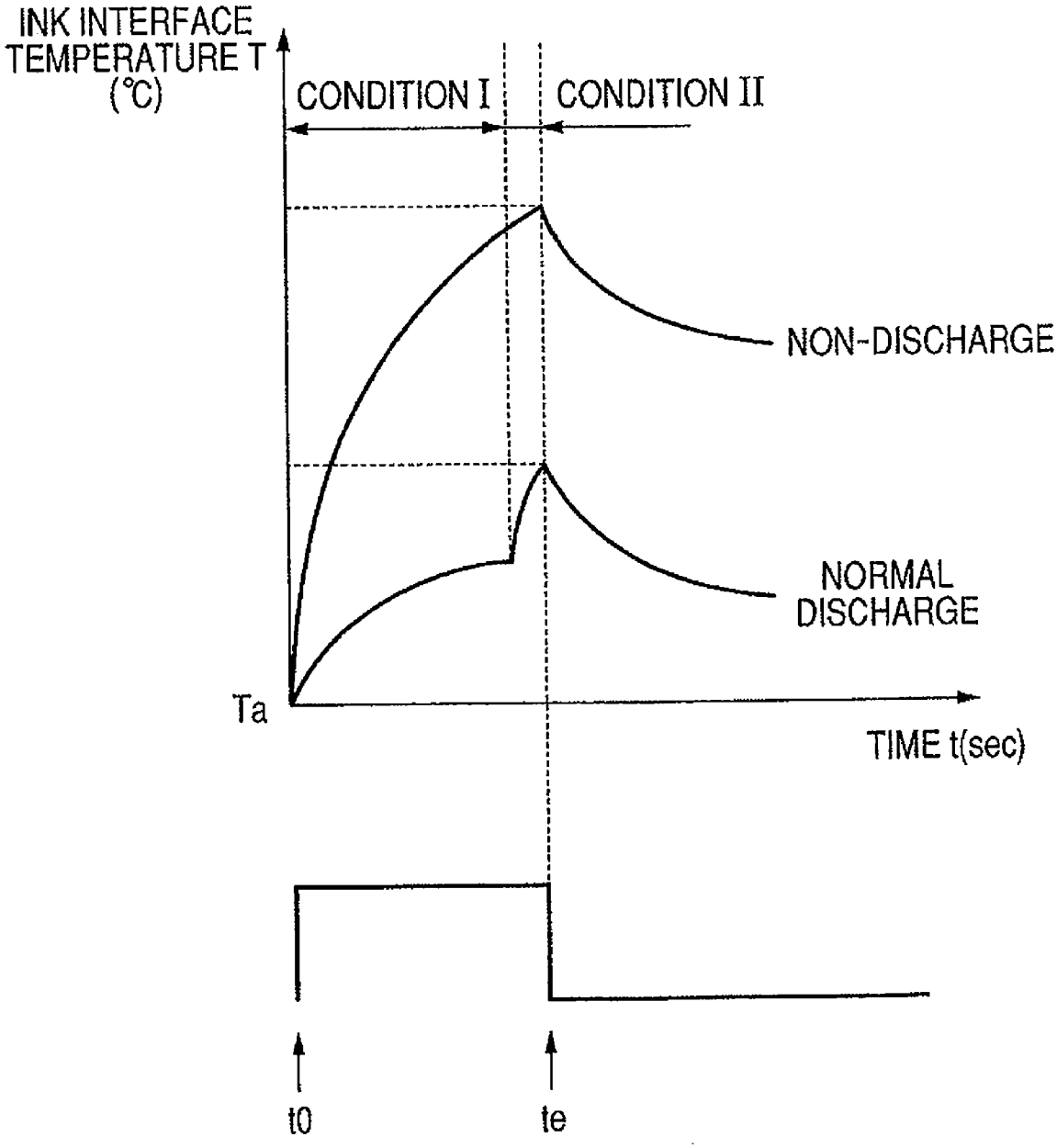
FIG. 3 is a condition chart illustrating temperature profiles on an ink interface of cavitation-resistant film in the recording head mounted on the recording apparatus being the first embodiment of the present invention.

At first, the temperature changes in the ink interface of the cavitation-resistant film 7 will be described when the heaters 5 undergo on and off operations. FIG. 3 is a condition chart illustrating temperature profiles on an ink interface of cavitation-resistant film. FIG. 3 illustrates the temperature profiles in the case where ink is discharged normally and in the case of ink non-discharge, respectively. Both of the temperature profiles illustrate the result obtained by temperature simulation with a computer.

In the case of the normal discharge, the heater 5 increases temperature from the point of time (timing to supply an application start signal t0) when electric energy is applied to an electrothermal transducing member included in the heater 5. Corresponding therewith, the temperature rises on the ink interface between the cavitation-resistant film 7 and the ink (condition I). The interface temperature of the cavitation-resistant film 7 reaches a constant temperature. Then bubbles are generated in the ink rapidly so as to bring the interface of the cavitation-resistant film 7 into a condition not to contact the ink directly. Consequently, the heaters 5 and the cavitation-resistant film 7 increase temperature rapidly due to the condition not to contact the ink directly (condition II). In a lapse of a constant time, supply of electric energy to the electrothermal transducing member is stopped (timing to supply an application stop signal te). Then the temperature of the heaters 5 and the cavitation-resistant film 7 drops gradually. Consequently, the bubbles in the ink disappear to bring the ink and the interface of the cavitation-resistant film 7 back to the initial contact condition.

On the other hand, in the case of the non-discharge, on and after the point of time when electric energy is applied to the electrothermal transducing member (timing to supply an application start signal t0), the temperature of the cavitation-resistant film 7 rises rapidly. For example, in the case of occurrence of ink non-discharge due to clogging of the flow channel with the bubbles, the ink and the interface of the cavitation-resistant film 7 are brought into a condition not to contact each other directly. Therefore, the temperature of the interface of the cavitation-resistant film 7 rises more rapidly than in the case of the normal discharge. In a lapse of a constant time, supply of electric energy to the electrothermal transducing member is stopped (timing to supply an application stop signal te). Then the temperature of the heaters 5 and the cavitation-resistant film 7 drops gradually.

Next, the temperature changes detected with the temperature detecting elements 3 will be described when the heaters 5 undergo on and off operations.

Figure 4:
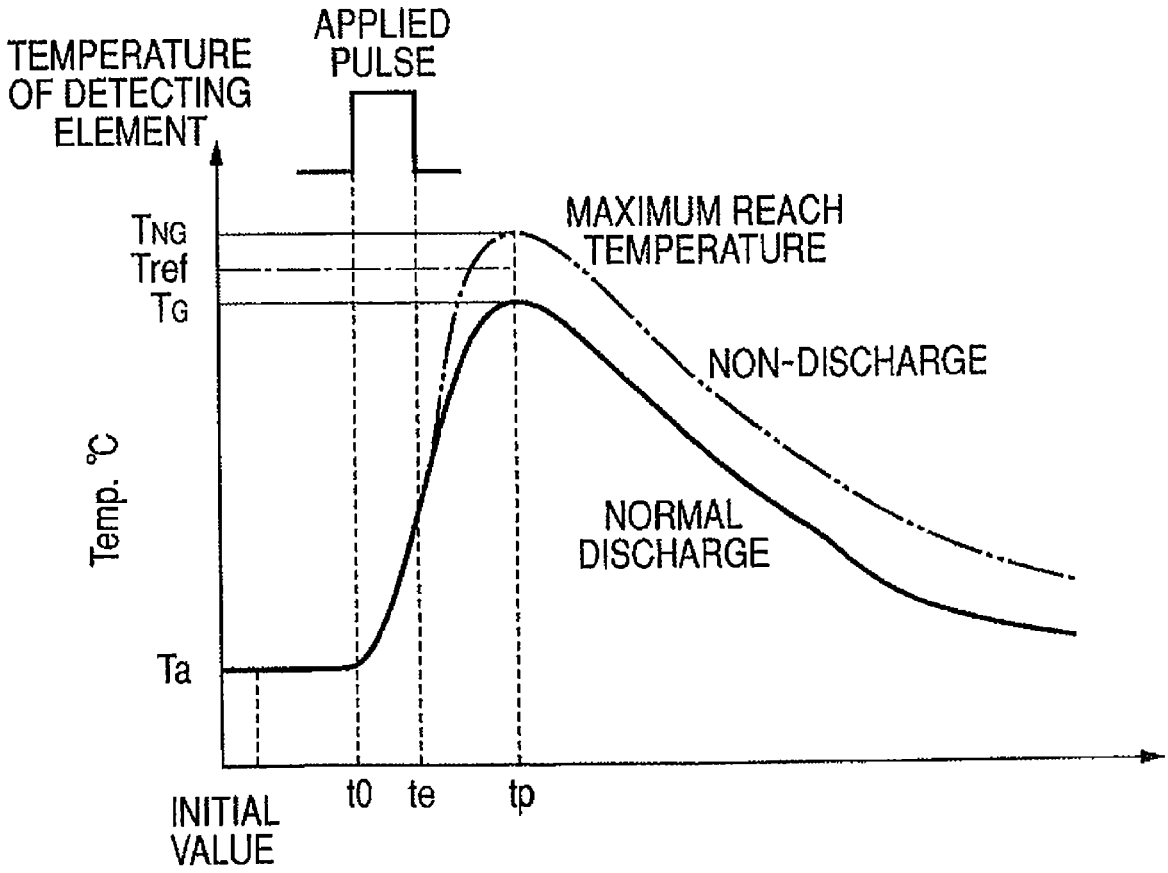
FIG. 4 is a condition chart illustrating temperature profiles in a temperature detecting element of the recording head mounted on the recording apparatus being the first embodiment of the present invention.

FIG. 4 is a condition chart illustrating temperature profiles in the temperature detecting element 3. FIG. 4 illustrates the temperature profiles in the case where ink is discharged normally and in the case of ink non-discharge respectively. Both of the temperature profiles illustrate the result obtained by temperature simulation with a computer.

In FIG. 4, the time t0 is timing when the application start signal is supplied. The time te is timing when the application start signal is supplied and is set to the timing in 0.8 μsec after the time t0. The heaters 5 are electrothermal transducing members with a resistant value of 200Ω and are driven by a pulse drive signal of 18 V. The drive condition for those heaters 5 is basically the same as temperature simulation in FIG. 3.

In both cases of normal discharge and non-discharge, at the time tp substantially 1.2 μsec from the timing te, the temperature value reaches the maximum temperature of the peak. The time period from the timing te up to the timing tp when the temperature value reaches a peak is a delay in the process of transmitting the heat generated by the heater 5 to the temperature detecting element 3. The delay time thereof is 1.2 μsec and is small. The result thereof tells that the temperature detecting element 3 has a rapid response property. That is a characteristic obtained by the structure with the temperature detecting elements 3 being arranged immediately below the electrothermal transducing members (heaters 5) (the Si substrate side) through the interlayer insulating film 4 having substantially 1.3 μsec thickness.

In addition, the temperature peak value $T_G$ in the case of a normal discharge is 218° C. The temperature peak value $T_{NG}$ in the case of non-discharge is 260° C. The balance between both temperature peak values is 52° C. Thus, the balance between the temperature peak values at the time of normal discharge and at the time of non-discharge is sufficiently large. Therefore, setting the standard temperature value Tref between the temperature peak value $T_{NG}$ and the temperature peak value $T_G$, it is possible to precisely determine the respective conditions of the normal discharge and the non-discharge. That is a characteristic obtained by the structure with the temperature detecting elements 3 being arranged immediately below the electrothermal transducing members through the interlayer insulating film between layers 4 having substantially 1.3 μm thickness as described above.

Figure 5A:
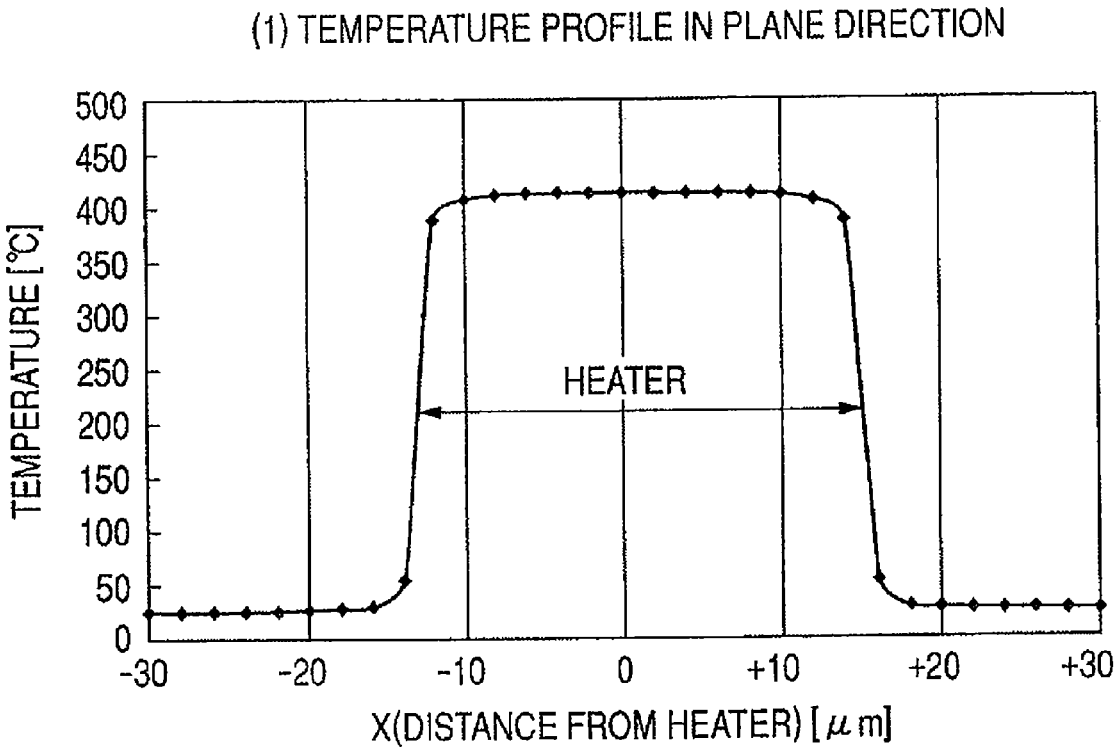
FIGS. 5A and 5B are condition charts illustrating temperature profiles as simulations on an arrangement position of a temperature detecting element.
Figure 5B:
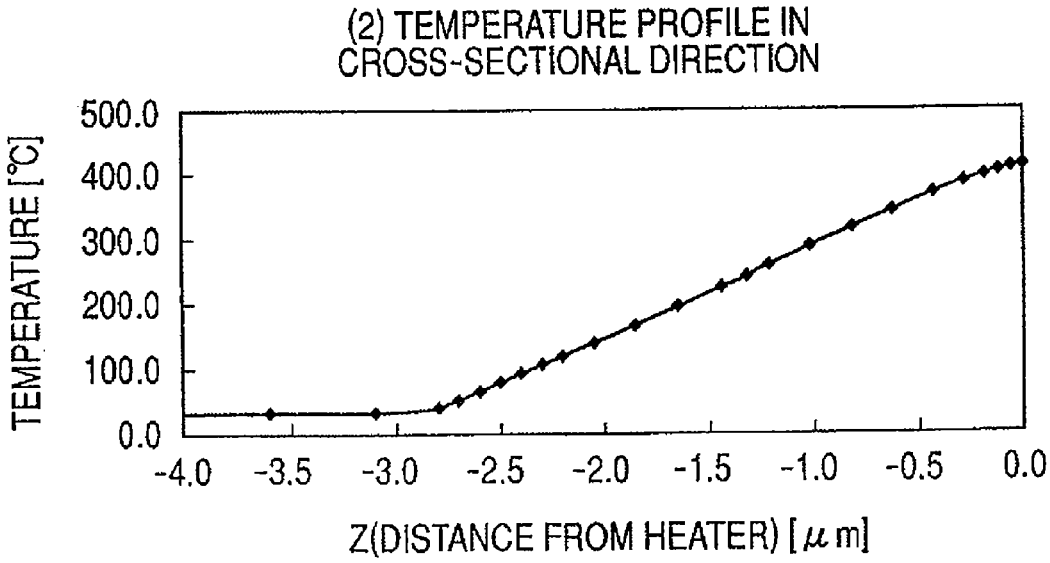

Next, in order to search for the optimum arrangement position of the temperature detecting element 3 on the heater 5, a computer was used to carry out simulation. FIGS. 5A and 5B illustrate temperature profiles including temperature drops in respective positions apart in the direction along the surface of the Si substrate and temperature drops in respective positions apart in the direction perpendicular to the surface of the Si substrate obtained by simulation with a computer.

FIG. 5A simulates temperature in a position apart from the heater center in the direction of the heater side along the Si substrate surface. The positions located at +12 μm and located at −12 μm from the center of the heater are equivalent to the heater end portions.

In addition, FIG. 5B simulates the temperature in respective positions with the direction apart from the Si substrate as positive in the direction perpendicular to the surface of the Si substrate from the center of the bottom surface of the heater. FIG. 5B is a temperature profile on the Si substrate side (the position to become negative in terms of distance from the heater).

The simulation hereof will be described in detail below.

Figure 16:
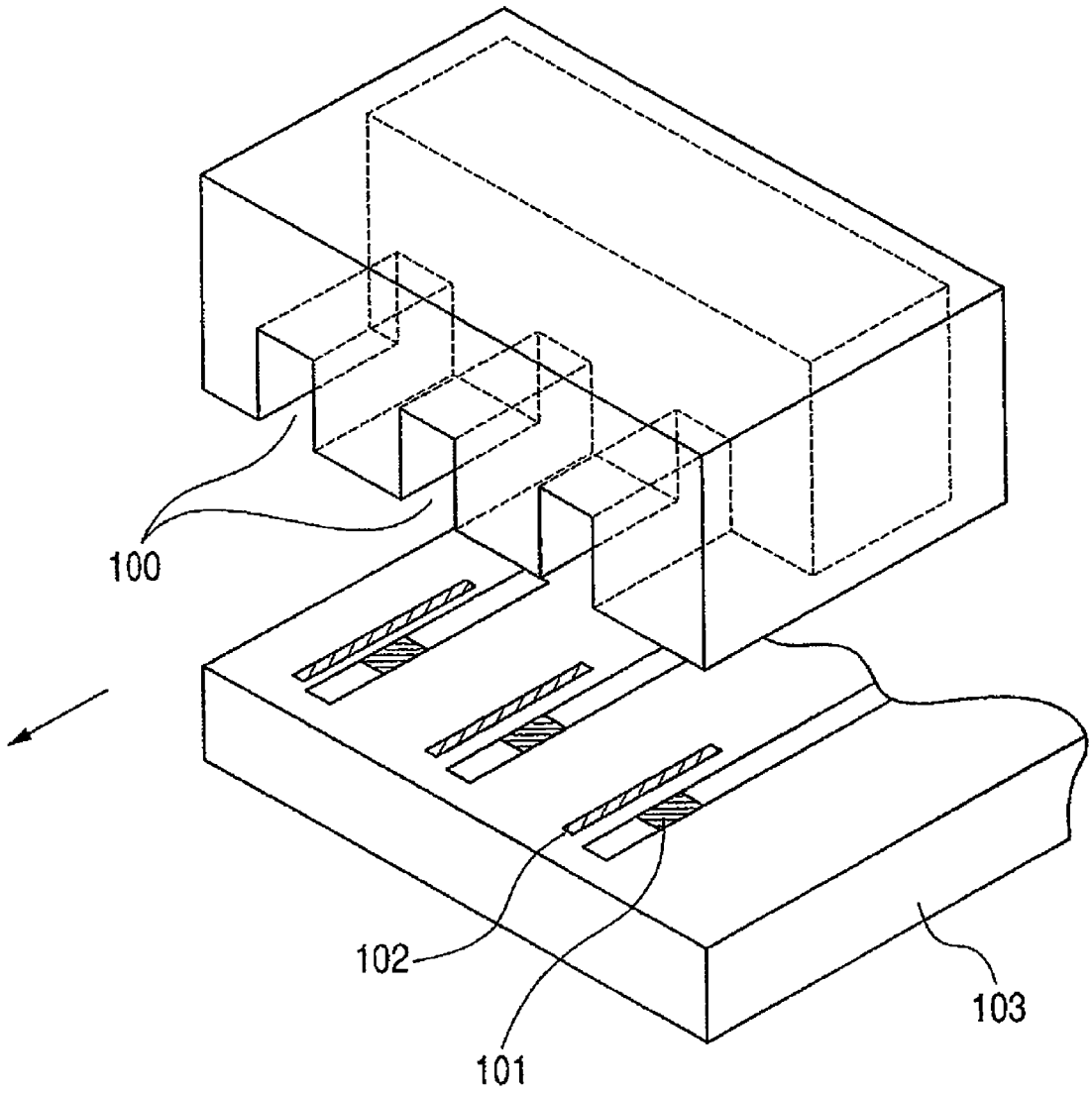
FIG. 16 is a perspective view illustrating major portions of a recording apparatus of a prior art.

In the substrate temperature profile in planar direction in FIG. 5A, temperature drops rapidly in the heater circumferential portion (position approximately at 15 μm from the heater center), the temperature remains low, giving rise to few temperature shifts. This tells that in the case of arranging the temperature detecting elements in the position as in FIG. 16 describing a prior art (the position extending sideways along the substrate plane toward the heater) does not enable detection of rapid and precise heater temperature. Moreover, in the future, accompanied by heaters being highly densely arranged, it will be difficult to secure the space to arrange the temperature detecting elements. In addition, it is apparent that consideration of constraints and the like on adjacent arrangement of heaters and temperature detecting elements due to various circumstances such as photoprocess resolution and the like at the time of fabrication does not enable arrangement, sideways of the heaters, of the temperature detecting elements enabling exact detection of temperature.

In addition, the temperature profile in cross-sectional direction of the substrate in FIG. 5B illustrates temperature dropping approximately linearly from the bottom plane of the heaters to the position (−2.8 μm) of approximately 2.8 μm toward the Si substrate side to thereafter reach constant temperature. That simulation employs an $SiO_2$ layer from 0 μm to −2.8 μm to an Si layer (Si substrate) from the position of −2.8 μm. An actual head substrate includes 1 μm to 2 μm insulating film between layers and a several-thousand Å heat accumulating layer thereunder. An Si substrate is present below the heat accumulating layer, where a semiconductor element for heating to drive heaters corresponding with ink discharge signals (see FIG. 1). The present simulation has been implemented with the temperature detecting element having been arranged at the position of −1.4 μm. The result thereof tells that the case of the temperature detecting element being arranged inside the Si substrate does not enable rapid response and preciseness for detecting defective discharge each for discharge timing on the level to be detected in the present embodiment.

The present embodiment includes the temperature detecting elements 3 arranged apart from the heaters 5 intermediated by an interlayer insulating film 4 in the position below the heaters 5 and above the heat accumulating layer 2 (in the position nearer the heaters). Moreover, the temperature detecting elements 3 are arranged immediately below the heaters. There, immediately below refers to mutual positional relation so as to stack at least the heaters 5 and the temperature detecting elements 3 in the direction perpendicular to the surface of the substrate. More preferably, such relation so as to bring the central positions of the heaters and the temperature detecting elements into correspondence is better. There, the heat accumulating layer 2 is a type of heat insulating layer provided under the heaters 5 (on the Si substrate side) in order to transmit heat energy generated by the heaters 5 to the ink in the ink flow path above the heaters 5. Therefore, the temperature detecting elements 3 are arranged in positions above the heat accumulating layer 2 (closer to the heaters).

The result thereof tells that the temperature detecting elements 3 are arranged below the heaters 5 (on the substrate side), that is, beyond the heaters 5 and between the heaters 5 and the heat insulating layer (heat accumulating layer 2) via the interlayer insulating film 4 as an insulating layer, thereby enabling temperature detection including rapid responsiveness and preciseness.

Here, it is apparent that a configuration to arrange the temperature detecting elements inside the Si substrate or on the rear surface of the Si substrate with several hundred μm thickness as comparison enables detection of temperature changes over the head after head drive for several minutes but not further. In addition, the configuration with the temperature detecting elements arranged sideways of the heaters is likewise. In any event, it is extremely difficult for the configuration to be treated as comparison to detect and determine temperature information corresponding with each nozzle rapidly each for discharge timing.

Next, a temperature detecting circuit for detecting temperature through a heat controlling circuit for controlling the drive of the heaters 5 and the temperature detecting elements 3 will be described.

Figure 6:
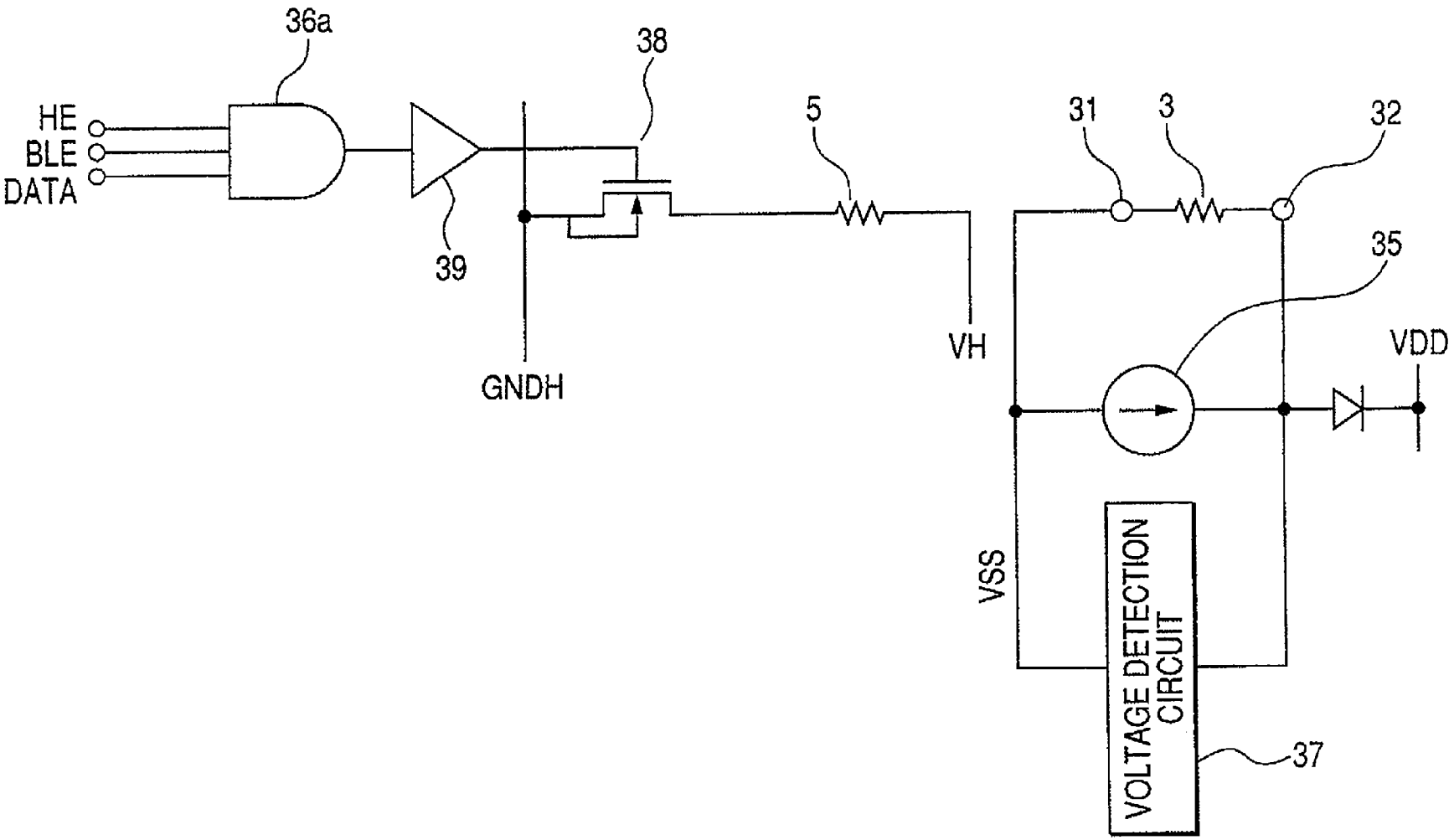
FIG. 6 is a block diagram illustrating a schematic configuration of a heater control circuit and the temperature detecting circuit applied to the recording head illustrated in FIG. 1 and FIG. 2.

FIG. 6 is a block diagram illustrating a schematic configuration of a heater controlling circuit and the temperature detecting circuit applied to the recording head illustrated in FIG. 1 and FIG. 2. With reference to FIG. 6, individual wiring 31 and 32 connected to each terminal of the temperature detecting elements 3 configures a part of a temperature detecting circuit for detecting temperature information from the temperature detecting elements 3. The temperature detecting circuit has a constant current circuit 35 for supplying the temperature detecting elements 3 with constant current and a voltage detection circuit 37 for detecting voltage generated between the individual wiring 31 and 32.

The heater controlling circuit has an AND circuit 36*a* for controlling the drive of the heaters 5. One terminal of the individual heater 5 is connected to the ground line GNDH via the switching element 38 (an nMOS transistor, for example). The other terminal is connected to a voltage supplying line VH. The AND circuit 36*a* takes a heater applied signal HE, a block selection signal BLE and a stored data DATA as an input respectively to derive logical multiplication of those inputs. Outputs of the AND circuit 36*a* are supplied as a switching element controlling signal to the switching element 38 via the amplifying circuit 39.

Figure 7:
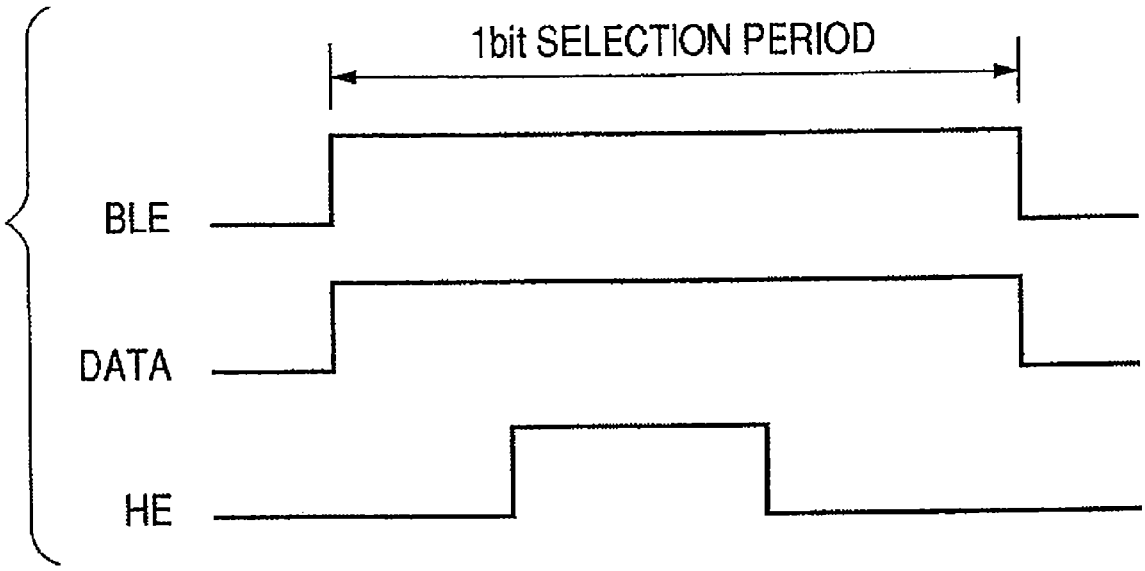
FIG. 7 is a timing chart illustrating operations of the heater control circuit illustrated in FIG. 6.

FIG. 7 is a timing chart illustrating operations of the heater controlling circuit illustrated in FIG. 6. The block selection signal BLE designates one bit selection period. The stored data DATA is set to take a high level (corresponding with "1") for the one bit selection period. Therefore, for the period with the block selection signal BLE being on a high level, the outputs of the AND circuit 36*a* will reach a high level. For the period with the outputs of the AND circuit 36*a* being on a high level, the switching element 38 is put on to supply the heater 5 with voltage.

The heaters 5 transduce electric energy to heat energy. With the heat energy from the heater 5, the temperature detecting element 3 provided immediately below the heater 5 generates temperature changes according to the temperature profiles illustrated in FIG. 4. Based on the voltage value detected by the voltage detection circuit 37, information (temperature information) corresponding with temperature changes in temperature detecting element 3 thereof is obtainable.

The above-described heater controlling circuit and the temperature detecting circuit may be formed on the Si substrate 1 illustrated in FIG. 1 or may be formed on a substrate different from the Si substrate 1.

Temperature information is obtained from the output signals (detected voltage) of the voltage detection circuit 37 to enable determination on whether a non-discharge state occurs or not based on that obtained temperature information. The determination on the non-discharge state is implemented based on the reference temperature value Tref illustrated in FIG. 4. Specifically, the case where the detected temperature value of the temperature detecting element 3 obtained based on the output signals of the voltage detection circuit 37 exceeds the preset reference temperature value Tref is determined to be a state of non-discharge. The circuit for determining the state of that non-discharge may be formed on the Si substrate 1 illustrated in FIG. 1 or may be formed on a substrate different from the Si substrate 1.

Figure 8:
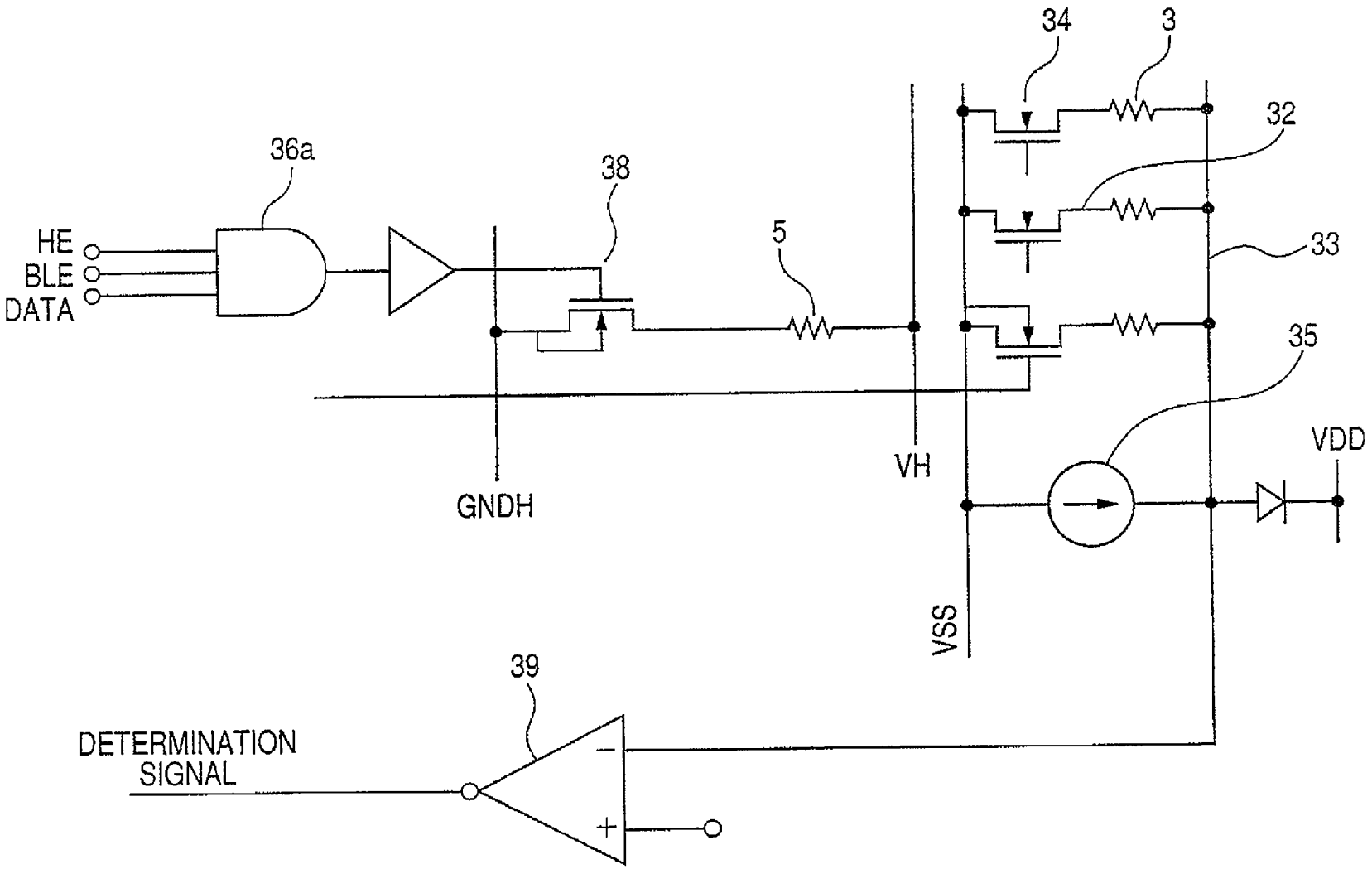
FIG. 8 is a block diagram illustrating a configuration of a circuit, to which the temperature of detecting circuit illustrated in FIG. 6, outputting a determination signal notifying non-discharge.

Next, applying the temperature detecting circuit illustrated in FIG. 6, a circuit for outputting the determination signal presenting non-discharge will be described. FIG. 8 illustrates the configuration of that circuit.

The circuit illustrated in FIG. 8 is provided with a comparator 39 replacing the voltage detection circuit in the circuit illustrated in FIG. 6. An "−" side input (inverting input) of the comparator 39 is connected to the line to which the individual wiring 32 is connected. The "+" side input (non-inverting input) of the comparator 39 is provided with reference voltage Vref.

The comparator 39 brings voltage Vt (temperature information) supplied to the side input and the reference voltage Vref supplied to the "+" side input into comparison. In the case where the voltage Vt exceeds the reference voltage Vref, the comparator 39 outputs a determination signal. The reference voltage Vref is voltage corresponding with the temperature Tref described in FIG. 4. The voltage Vt (temperature information) is voltage corresponding with the temperature of detecting element T illustrated in FIG. 4.

In the case of normal discharge, Vt<Vref will be obtained. On the other hand, in the case of the non-discharge, Vt>Vref will be obtained.

The comparator circuit 39 may be formed on the Si substrate 1 illustrated in FIG. 1 or may be formed on a substrate different from the Si substrate 1.

In addition, the reference voltage Vref supplied to the "+" side input of the comparator circuit 39 may be a fixed value or may be a variable value following environmental temperature and a temperature change at the time of driving. In any case, the value of the reference voltage Vref is set in consideration of the relation among the temperature Tref, the temperature peak value $T_G$ in the case of the normal discharge and the temperature peak value $T_{NG}$ in the case of non-discharge respectively illustrated in FIG. 4.

As described above, according to the present embodiment, arrangement of the temperature detecting element immediately below the electrothermal transducing member to sandwich the insulating layer can configure a temperature detecting circuit with rapid responsiveness and little delay and can realize a circuit enabling precise determination on the states of normal discharge and non-discharge. Within the range without departing the gist hereof, the configuration and operations of the storage apparatus of the present embodiment can be modified appropriately.

Figure 9:
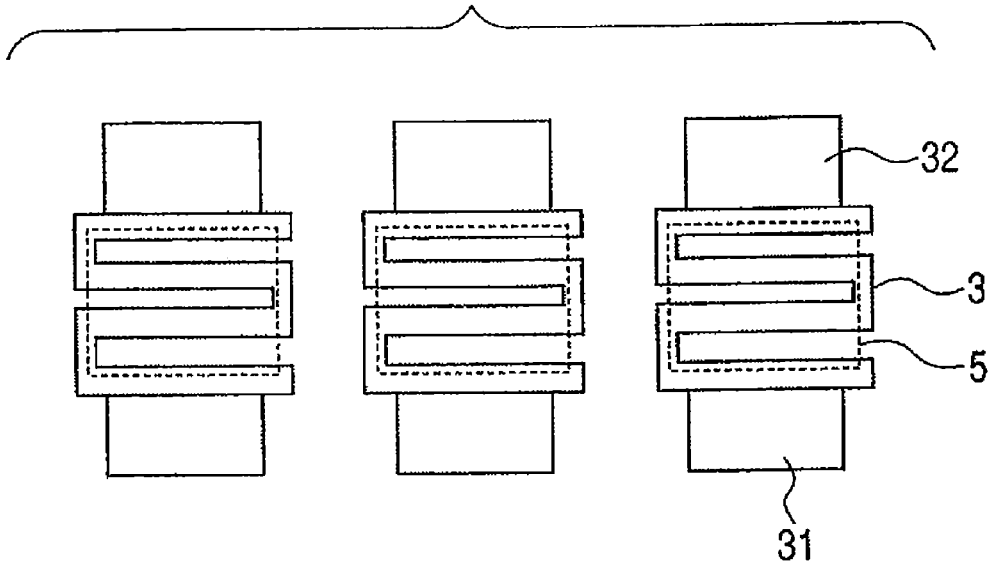
FIG. 9 is a plan view illustrating another shape of the temperature detecting element used in the recording head mounted on the recording apparatus of the first embodiment of the present invention.

For example, the temperature detecting element 3 may be a linear resistor pattern presenting a shape with a plurality of folds (hereinafter to be referred to as "snake shape") as illustrated in FIG. 9. The case of using a square-shaped temperature detecting element 3 as illustrated in FIG. 2 can form a flat plane shape for the heater 5 formed on the temperature detecting element 3 to sandwich the insulating film between layers 4 and can improve stability of discharge operations. In contrast, the case of using the snake shaped temperature detecting element 3 as illustrated in FIG. 9 can set larger resistance value in the temperature detecting element 3 and therefore enables more accurate detection on micro temperature changes.

Second Embodiment

Figure 10:
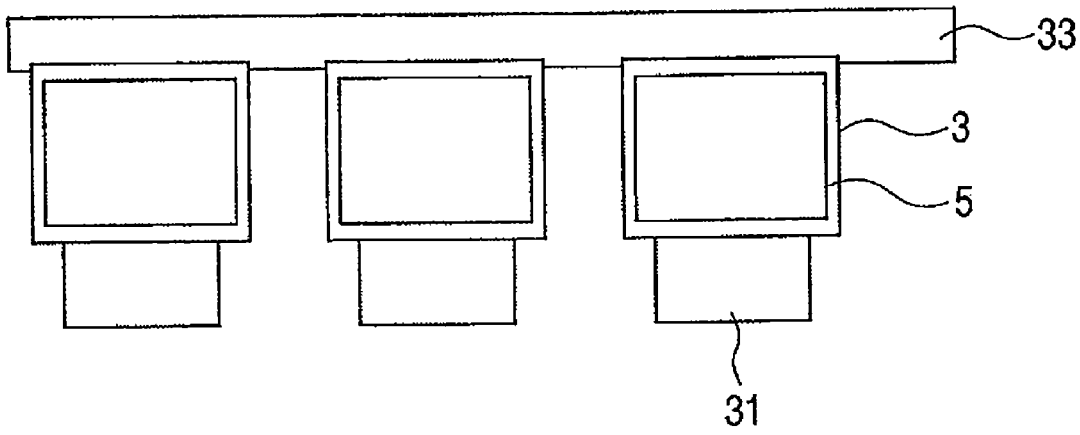
FIG. 10 is a plan view of a recording head mounted on a recording apparatus being a second embodiment of the present invention.

FIG. 10 is a plan view of a recording head mounted on a recording apparatus being a second embodiment of the present invention. In FIG. 10, a discharge nozzle portion including a discharge port, a liquid route and the like is omitted.

The recording head of the present embodiment is obtained by replacing the individual wiring 32 with a common wiring 33 in the recording head illustrated in FIG. 2 and has a stacked structure likewise the one illustrated in FIG. 1. The thin film resistor member included in the temperature detecting element 3 is formed separately and independently immediately below the electrothermal transducing member included in each of heaters 5. Here, the arrangement position of the temperature detecting element 3 is the optimum position obtained as a result of simulation on the above described first embodiment.

An end (terminal) of the temperature detecting element 3 is connected to individual wiring 31. The other end (terminal) is connected to common wiring 33. The individual wiring 31 and the common wiring 33 made of Al and the like and is formed together with the temperature detecting element 3 on the Si substrate.

According to the recording head of the present embodiment, in addition to the characteristic of the first embodiment, the other terminal of the temperature detecting element 3 is structured to include common wiring, giving rise to an advantage in layout so as to enable simpler configuration of the wiring layer. In addition, time-division outputting of outputs (temperature information) from a plurality of temperature detecting elements 3 is enabled to give rise to an advantage in simplifying information processing.

Next, a temperature detecting circuit for outputting time-division outputting of outputs (temperature information) from the temperature detecting elements 3 will be described.

Figure 11:
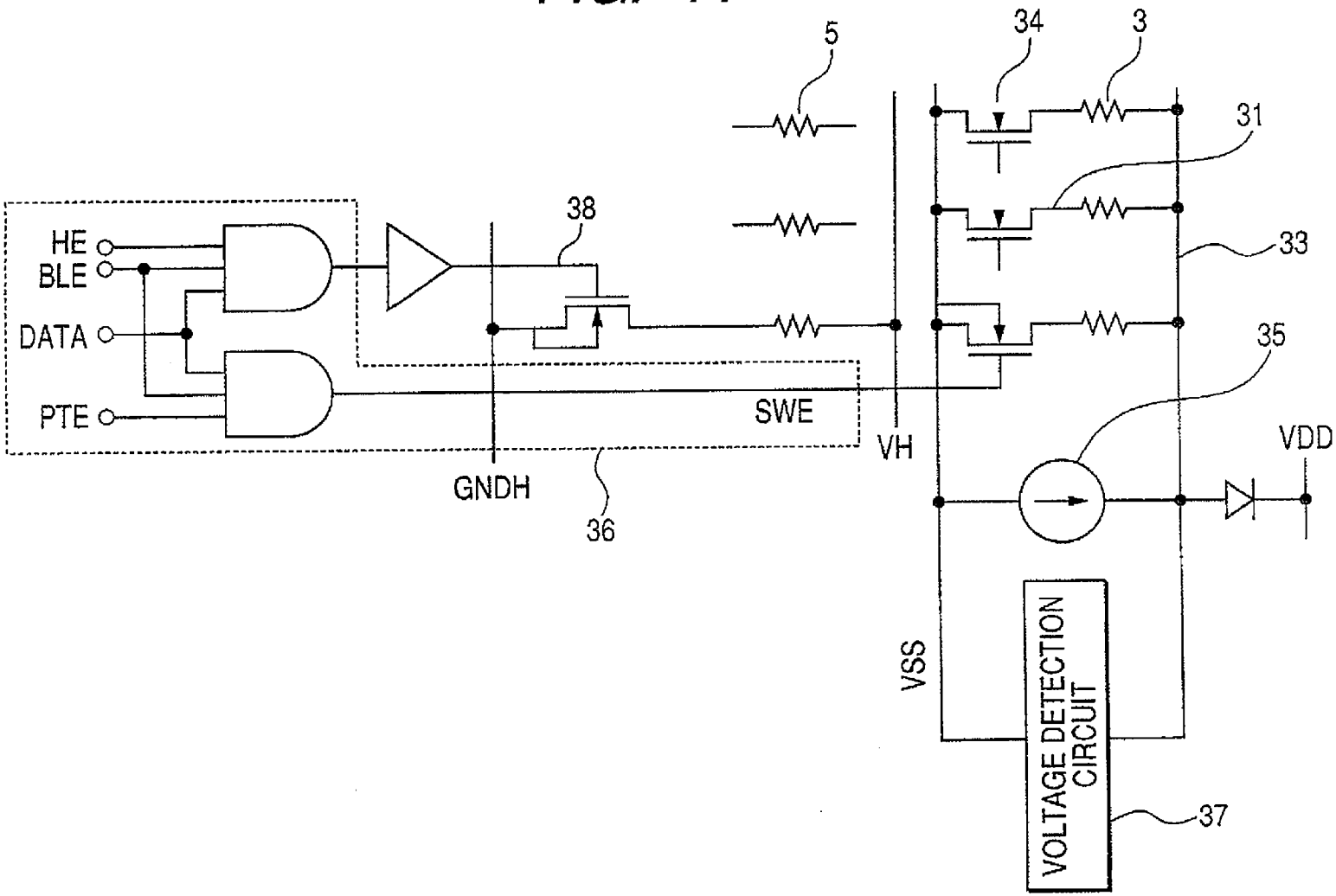
FIG. 11 is a block diagram illustrating a schematic configuration of a control circuit and a temperature detecting circuit applied to the recording head illustrated in FIG. 10.

FIG. 11 is a block diagram illustrating a schematic configuration of a control circuit and a temperature detecting circuit applied to the recording head illustrated in FIG. 10. With reference to FIG. 11, individual wiring 31 connected to one terminal of the temperature detecting element 3 is connected to the line provided with voltage VSS via the switching element 34. A constant current circuit 35 for supplying the temperature detecting element 3 with constant current 35 and a voltage detection circuit 37 for detecting voltage are connected to the line provided with the voltage VSS and each of the temperature detecting elements 3 respectively. The individual wiring 31 and the common wiring 33 configure a part of a temperature detecting circuit.

One terminal of the individual heater 5 is connected to the ground line GNDH via the switching element 38. The other terminal of the individual heater 5 is connected to a voltage supplying line VH. The switching elements 34 and 38 include nMOS transistors, for example.

The controlling circuit 36 is provided to each of the discharge nozzles (discharge ports) including the temperature detecting element 3 and the heater 5. The controlling circuit 36 controls the switching element 34 connected to the temperature detecting element 3 and the switching element 38 connected to the heater 5 and includes two AND circuits **36*a* and 36*b*. The AND circuit 36*a* takes a heater applied signal HE, a block selection signal BLE and a stored data DATA as an input respectively to derive logical multiplication of those inputs. The AND circuit 36*b* takes a block selection signal BLE, a print data DATA and a signal PTE as an input respectively to derive logical multiplication of those inputs. Outputs of the AND circuit 36*a* are supplied as a switching element controlling signal to the switching element 38 via the amplifying circuit 39. Outputs of the AND circuit 36*b* are supplied as a switching element controlling signal SWE to the switching element 34**.

Figure 12:
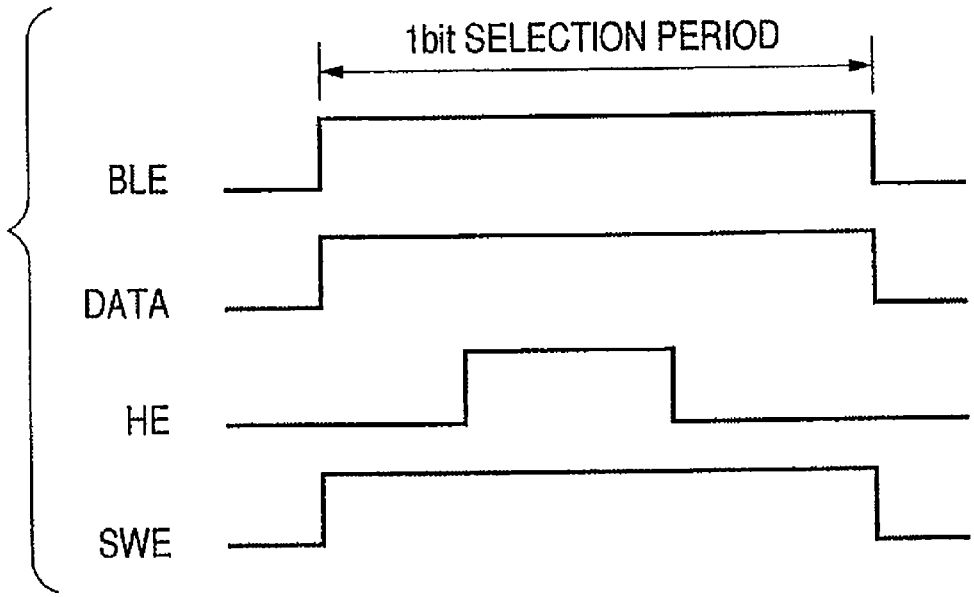
FIG. 12 is a timing chart illustrating operations of the control circuit illustrated in FIG. 11.

FIG. 12 is a timing chart illustrating operations of the control circuit 36 illustrated in FIG. 11. The block selection signal BLE designates one bit selection period. The stored data DATA is set to take a high level (corresponding with "1") for the one bit selection period. Therefore, for the period with the block selection signal BLE being on a high level, the outputs of the AND circuit **36*a* will reach a high level. For the period with the outputs of the AND circuit 36*a* being on a high level, the switching element 38 is put on to supply the heater 5** with voltage.

The switching element controlling signal SWE being the outputs of the AND circuit **36*b* will reach a high level for the period with the signal PTE being on a high level. For the period with the outputs of that switching element controlling signal SWE being on a high level, the switching element 34 comes into the on state. The switching element in the on state is connected to the temperature detecting element 3, which is provided with current from the constant current circuit 35. The voltage detection circuit 37 detects voltage corresponding with the resistance value of the temperature detecting element 3**.

The heaters 5 transduce electric energy to heat energy. With the heat energy from the heater 5, the temperature detecting element 3 provided immediately below the heater 5 to sandwich the insulating layer generates temperature changes according to the temperature profiles illustrated in FIG. 4. Thereby, based on the voltage value detected by the voltage detection circuit 37, information (temperature information) corresponding with temperature changes in temperature detecting element 3 thereof is obtainable.

The temperature detecting circuit illustrated in FIG. 11 generates a switching element controlling signal SWE so that each of the switching elements 34 is switched to the on state sequentially. Thereby, the voltage detection circuit 37 will output a signal corresponding with temperature information from each of the switching elements 34 in a time-division state.

The temperature detecting circuit and the controlling circuit may be formed on the Si substrate 1 illustrated in FIG. 1 or may be formed on a substrate different from the Si substrate 1.

Also in the present embodiment, temperature information of the temperature detecting elements 3 connected to each of the switching elements 34 is obtained from the output signals of the voltage detection circuit 37 to enable determination on whether a non-discharge state occurs or not based on that obtained temperature information. The determination on the non-discharge state is implemented based on the reference temperature value Tref illustrated in FIG. 4. Specifically, the case where the value of the switching element 34 obtained based on the output signals of the voltage detection circuit 37 exceeds the preset reference temperature value Tref is determined to be a state of non-discharge. The circuit for determining the state of the non-discharge may be formed on the Si substrate 1 illustrated in FIG. 1 or may be formed on a substrate different from the Si substrate 1.

Figure 13:
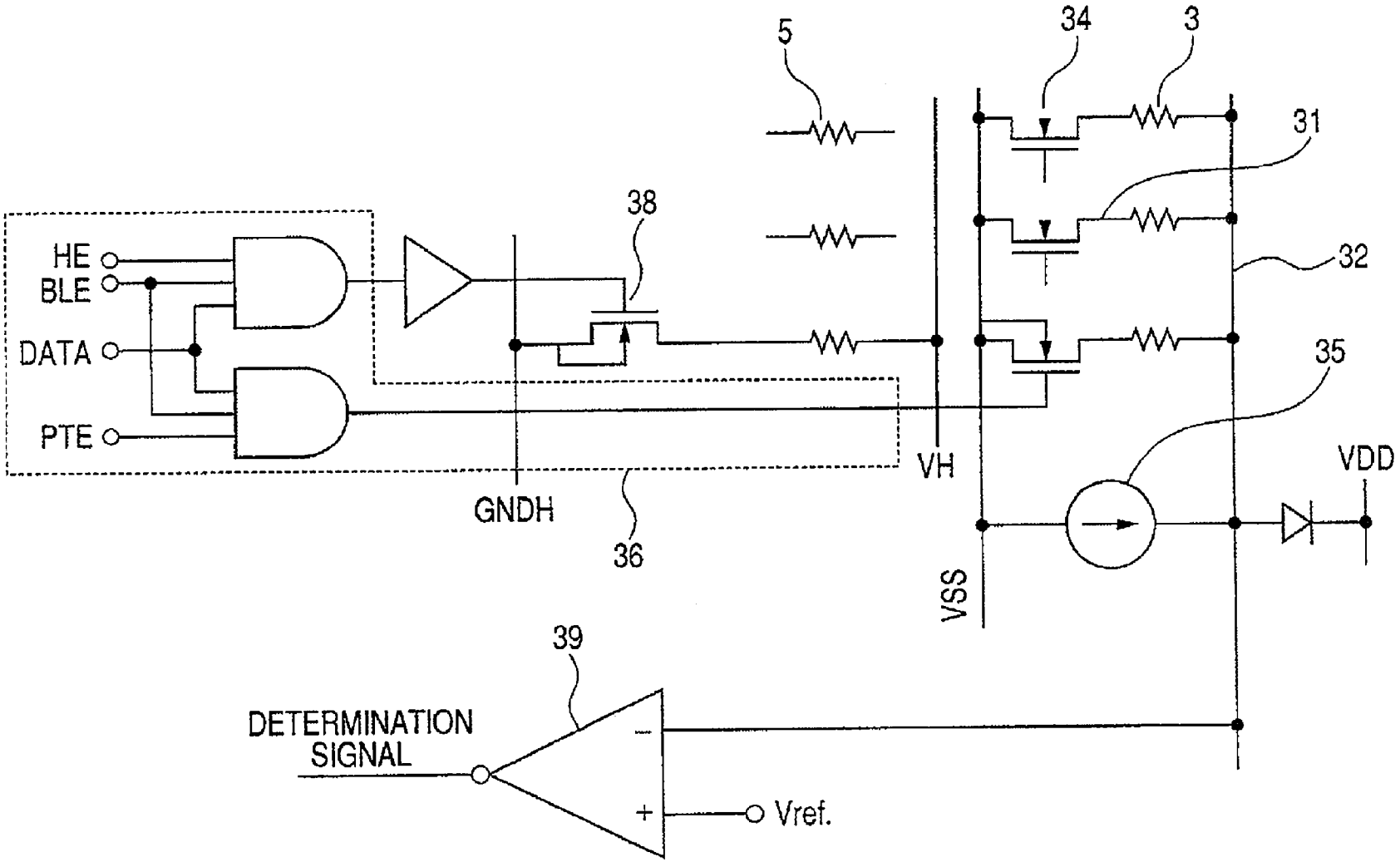
FIG. 13 is a block diagram illustrating a configuration of a circuit, to which the temperature detecting circuit illustrated in FIG. 11 is applied, for outputting determination signals.

Next, applying the circuit illustrated in FIG. 11, a circuit for outputting the determination signal presenting non-discharge will be described. FIG. 13 illustrates that circuit configuration.

The circuit illustrated in FIG. 13 includes a comparator 39 for each of the controlling circuits 36 in addition to the circuit illustrated in FIG. 11. An "–" side input of that comparator 39 is connected to the common wiring 33 to which the other terminal of the temperature detecting element 3 is connected commonly. The "+" side input of the comparator 39 is provided with reference voltage Vref. The comparator 39 outputs a determination signal.

The comparator 39 brings voltage Vt (temperature information) supplied to the side input and the reference voltage Vref supplied to the "+" side input into comparison and outputs a determination signal based on a comparison result thereof. The reference voltage Vref is voltage corresponding with the temperature Tref described in FIG. 4. The voltage Vt (temperature information) is voltage corresponding with the temperature of detecting element T illustrated in FIG. 4.

In the case of normal discharge, Vt Vref will be obtained so that the determination signal is set to the high level (or the signal level on "+" side). In the case of the non-discharge, Vt>Vref will be obtained so that the determination signal is set to the low level (or the signal level on "−" side).

The comparator circuit 39 may be formed on the Si substrate 1 illustrated in FIG. 1 or may be formed on a substrate different from the Si substrate 1.

In addition, the reference voltage Vref supplied to the "+" side input of the comparator circuit 39 may be a fixed value or may be a variable value following environmental temperature and a temperature change at the time of driving. In any case, the value of the reference voltage Vref is set in consideration of the relation among the temperature Tref, the temperature peak value $T_G$ in the case of the normal discharge and the temperature peak value $T_{NG}$ in the case of non-discharge respectively illustrated in FIG. 4.

Also in the above-described present embodiment, arrangement of the temperature detecting element immediately below the electrothermal transducing member can configure a temperature detecting circuit with rapid responsiveness and little delay and can realize a circuit enabling precise determination on the states of normal discharge and non-discharge. Within the range without departing from the gist hereof, the configuration and operations of the storage apparatus of the present embodiment can be modified appropriately.

Figure 14:
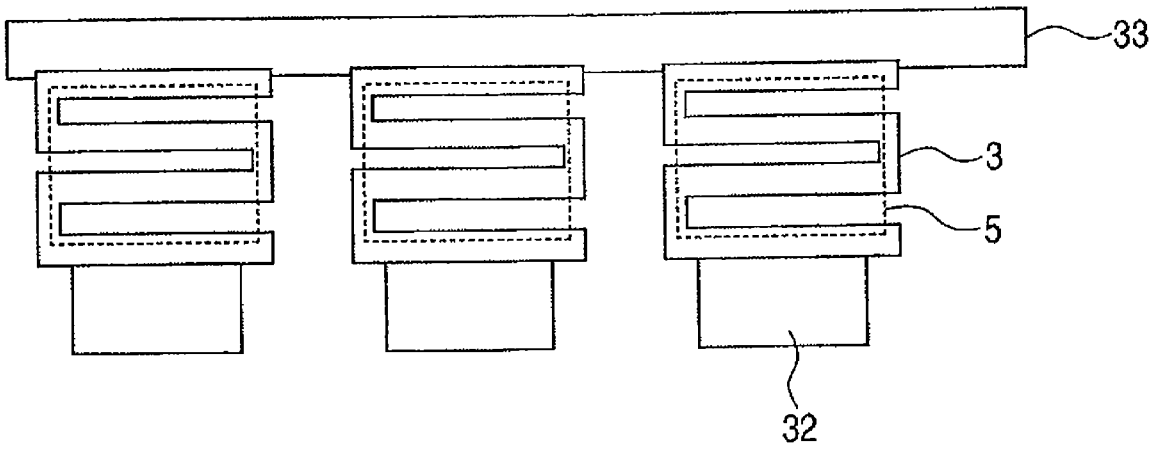
FIG. 14 is a plan view illustrating another shape of the temperature detecting element used in the recording head mounted on the recording apparatus of the second embodiment of the present invention.

For example, the temperature detecting element 3 may be a linear resistor pattern presenting a shape with a plurality of folds, that is, so-called snake shape as illustrated in FIG. 14. The case of using a square-shaped temperature detecting element 3 as illustrated in FIG. 10 can form a flat plane shape for the heaters 5 formed on the temperature detecting element 3 to sandwich the interlayer insulating film 4 and can improve stability of discharge operations. In contrast, the case of using the snake shaped temperature detecting element 3 as illustrated in FIG. 14 can set a larger resistance value in the temperature detecting element 3 and therefore enables more accurate detection on temperature changes on a micro-level.

Figure 15:
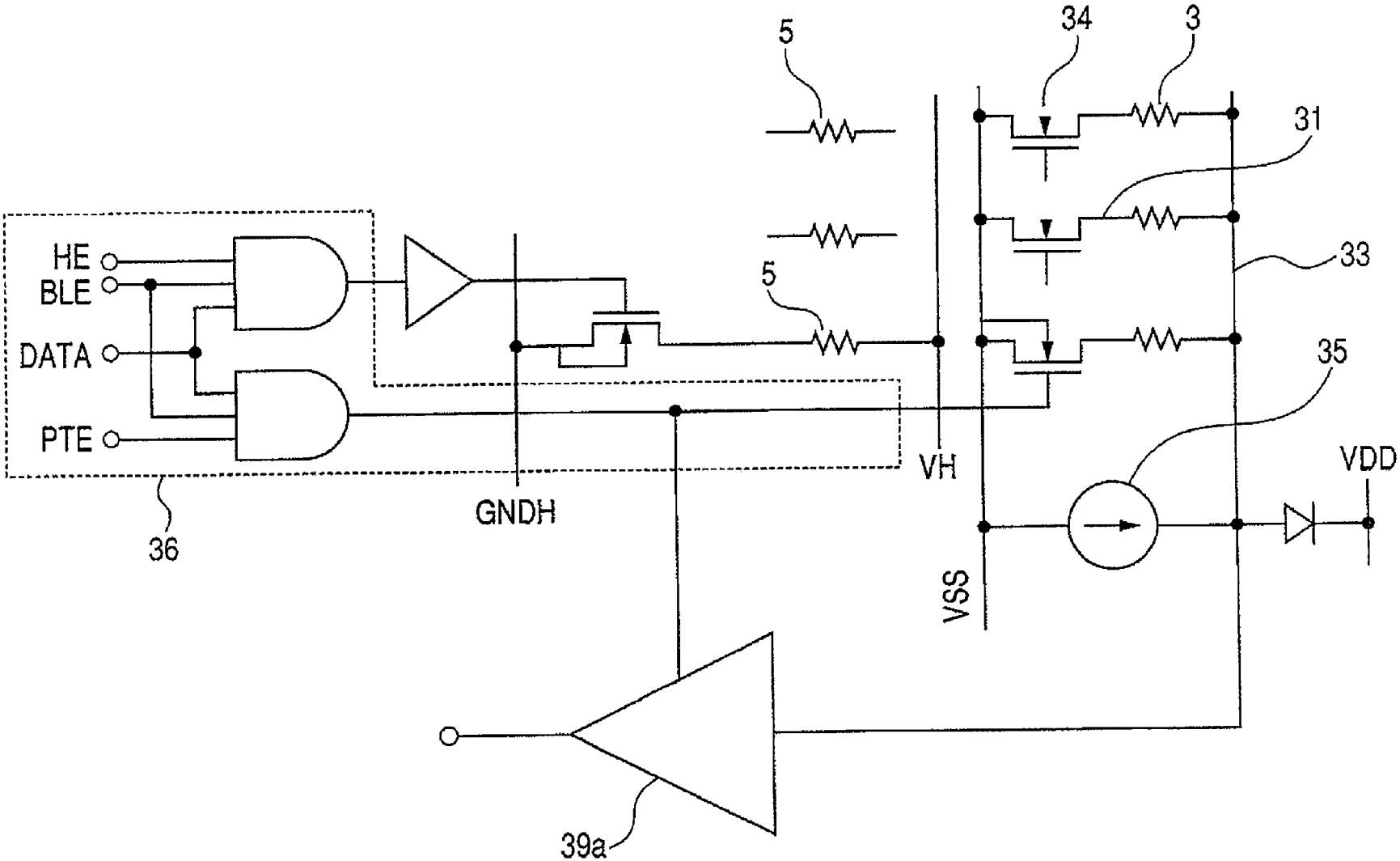
FIG. 15 is a block diagram illustrating a configuration of a circuit applied to the recording apparatus being the second embodiment of the present invention for transducing temperature information to digital values.

In addition, a configuration as illustrated in FIG. 15 may be taken so as to transduce temperature detected through the temperature detecting element 3 to digital values. In such a case, the voltage detection circuit 37 of the circuit illustrated in FIG. 11 is replaced by an AD converter 37*a*. The input of the AD converter 37*a* is connected to the common wiring 33. The controlling circuit controls each of the switching elements 34. Thereby information of detected temperature obtained by each of the temperature detecting elements 3 is output from the AD converter 37*a* on a time-division basis. The configuration with such an AD converter 37*a* gives rise to an advantage in improvement in noise immunity.

The above-identified circuit outputting the determination signals and AD converter can be mounted on any of the recording head and the recording apparatus to form an embodiment.

Any of the above-identified embodiments generates an application stoppage signal in the non-discharge case to enable a stoppage of signal supply to the heaters.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-098674, filed Mar. 31, 2006, and 2007-066591, filed Mar. 15, 2007 which are hereby incorporated by reference herein in their entirety.

What is claimed is:

1. A liquid discharge head comprising:

an electrothermal transducing member for generating heat energy for discharging liquid from a discharge port upon application of electrical energy; and a temperature detecting circuit comprising a temperature detecting element for substantially measuring a temperature of said electrothermal transducing member, which increases in accordance with application of the electrical energy, said temperature detecting circuit comparing a maximum temperature of said electrothermal transducing member measured by said temperature detecting element with a reference temperature, wherein said temperature detecting element comprises a material having a resistance value varying in accordance with the temperature, said temperature detecting circuit comprises a constant current circuit for supplying a constant current to said temperature detecting element, a voltage detection circuit for detecting a voltage applied to said temperature detecting element, and a first switching element for controlling a supply of the current flowing in said temperature detecting element, and said electrothermal transducing member comprises a second switching element for controlling a supply of the electrical energy, said first switching element and said second switching element being controlled with a common signal.

2. The liquid discharge head according to claim 1, wherein the reference temperature is between a first temperature reached when the liquid is discharged from the discharge port and a second temperature reached when the liquid is not discharged from the discharge port.

3. The liquid discharge head according to claim 1, wherein said temperature detecting circuit compares the maximum temperature with the reference temperature by comparing a maximum voltage applied to said temperature detecting element with a reference voltage value corresponding to the reference temperature.

4. The liquid discharge head according to claim 3, wherein the reference voltage value is a value between a first voltage which is a maximum voltage applied to said temperature detecting element reached when the liquid is discharged from discharge port and a second voltage which is a maximum voltage applied to said temperature detecting element reached when the liquid is not discharged from the discharge port.

* * * * *